US008789228B2

(12) United States Patent
Driesen et al.

(10) Patent No.: US 8,789,228 B2
(45) Date of Patent: Jul. 29, 2014

(54) TOOTHBRUSH AND BRISTLE AND BRUSH HEAD FOR A TOOTHBRUSH

(75) Inventors: Georges Driesen, Weilrod (DE); Michael Schmid, Frankfurt am Main (DE)

(73) Assignee: Braun GmbH, Kronberg (DE)

( * ) Notice: Subject to any disclaimer, the term of this patent is extended or adjusted under 35 U.S.C. 154(b) by 431 days.

(21) Appl. No.: 13/129,049

(22) PCT Filed: Nov. 4, 2009

(86) PCT No.: PCT/IB2009/054905

§ 371 (c)(1),
(2), (4) Date: Oct. 25, 2011

(87) PCT Pub. No.: WO2010/052659

PCT Pub. Date: May 14, 2010

(65) Prior Publication Data

US 2012/0036654 A1 Feb. 16, 2012

(30) Foreign Application Priority Data

Nov. 5, 2008 (EP) ..... 08019331

(51) Int. Cl.
*A46B 9/04* (2006.01)
*A46B 9/02* (2006.01)
*A46D 1/00* (2006.01)

(52) U.S. Cl.
CPC ..... *A46B 9/028* (2013.01); *A46D 1/0238* (2013.01)
USPC ..... 15/28; 15/22.2; 15/22.1; 15/207.2

(58) Field of Classification Search
CPC ..... A46B 9/06; A46B 9/028; A46D 1/023; A46D 1/0238
USPC ..... 15/22.1, 22.2, 28, 167.1, 207.2, DIG. 6
See application file for complete search history.

(56) References Cited

U.S. PATENT DOCUMENTS 3,295,156 A 1/1967 Brant
6,871,373 B2 3/2005 Driesen et al.

(Continued)

FOREIGN PATENT DOCUMENTS

DE 20 2007 017676 U1 3/2008
EP 11 13 737 B1 9/2003

(Continued)

OTHER PUBLICATIONS

International Search Report for PCT/IB2009/054905 dated Jun. 25, 2010.

*Primary Examiner* — Shay Karls
(74) *Attorney, Agent, or Firm* — John P. Colbert; James E. Oehlenschlager

(57) ABSTRACT

The invention is directed to a bristle for a toothbrush, said bristle being comprised of a plastic monofilament, with the preferably cloverleaf-shaped bristle body having several longitudinal ribs arranged in star shape and projecting laterally from a core section of the bristle body. The invention is also directed to a brush head for an electric toothbrush having at least one bristle tuft with at least one such bristle as well as to an electric toothbrush having such a brush head. According to the invention, the bristle of the type initially referred to is configured to be self-fanning in such a manner that the cleaning forces acting on the bristles during normal brushing cause the bristle to split open at its free end. As a result, the need to use complex splitting methods and corresponding splitting machines in the manufacture of the toothbrush can be obviated.

10 Claims, 4 Drawing Sheets

(56) References Cited

U.S. PATENT DOCUMENTS

| | | | |
|---|---|---|---|
| 6,886,207 | B1 | 5/2005 | Solanki |
| 2002/0138962 | A1 | 10/2002 | Brown et al. |
| 2005/0060822 | A1 | 3/2005 | Chenvainu et al. |
| 2006/0080794 | A1 | 4/2006 | Punshon |

FOREIGN PATENT DOCUMENTS

| | | | |
|---|---|---|---|
| JP | 2001/169827 | A | 6/2001 |
| JP | 2002/360344 | A | 12/2002 |
| JP | 2007/244546 | A | 9/2007 |
| WO | WO 98/04167 | A | 2/1998 |
| WO | WO 00/01276 | | 1/2000 |
| WO | WO 00/15078 | A | 3/2000 |

TOOTHBRUSH AND BRISTLE AND BRUSH HEAD FOR A TOOTHBRUSH

The present invention relates to a bristle for a toothbrush, said bristle being comprised of a plastic monofilament, with the preferably cloverleaf-shaped bristle body having several longitudinal ribs arranged in star shape which project laterally from a core section of the bristle body. This invention relates in addition to a brush head for an electric toothbrush with at least one bristle tuft having at least one such bristle and to an electric toothbrush with such a brush head.

EP 11 13 737 B1 or U.S. Pat. No. 6,871,373 B2 disclose bristles for a toothbrush which have a substantially cloverleaf-shaped cross-section. At the free ends the bristles are fanned out for some length such that the longitudinal ribs of the bristle body which form the cloverleaf-shaped cross-section protrude singly at the end of the bristle and form an on the whole flower-shaped bristle end. Such split bristle ends afford many different advantages including, for example, improved nestling against the tooth surface, better distribution of cleaning agent on the tooth surface and a high cleaning effect on the smooth surfaces. On the other hand, hitherto known tufts of such split bristles are less advantageous with regard to removing plaque or interproximal cleaning.

Above all, however, such fanned out bristle tufts are complex to manufacture. Special splitting machines are typically used which split open the bristles by means of high-speed rotary blades. This takes place in several process steps as described, for example, in WO 00/01276.

As explained in EP 11 13 737 B1, it was also proposed in the art to integrate so to speak points of preferred breaking in such cloverleaf-shaped bristles in order to facilitate the splitting open. During extrusion of the bristle body the extrusion strand is first split open into several separate strands which are then re-joined. Suitable points of preferred breaking result at the joints because interfaces between corresponding material sections are created there. As a result, the bristles break across their full width when split open such that the core region of the bristle body is also split.

Based on the foregoing, it is an object of the present invention to provide an improved bristle and an improved bristle support, each of the type initially referred to, as well as an improved toothbrush, which prevent the disadvantages of the prior art while developing the art further in advantageous manner. It is intended to provide preferably an easy-to-manufacture electric toothbrush which on the one hand achieves a good nestling of the bristle tufts against the tooth surface, a good distribution of cleaning agent on the tooth surface and an agreeable cleaning sensation, while on the other hand also showing a good cleaning performance in the removal of plaque and in the removal of stubborn dental debris.

According to the invention this object is accomplished by a bristle according to claim 1, a bristle support according to claim 11 and a toothbrush according to claim 33. Preferred embodiments of the invention are the subject-matter of the dependent claims.

It is proposed therefore to first insert into the toothbrush unsplit bristles with laterally protruding longitudinal ribs and a preferably cloverleaf-shaped cross-section and to configure them such that they split open automatically during brushing. According to the invention, the bristle of the type initially referred to is of the self-fanning type, such that the cleaning forces acting on the bristles during normal cleaning lead to a splitting open of the bristle at its free end. This obviates the need to provide complex splitting processes and corresponding splitting machines for manufacturing the toothbrush.

Any reference to the bristle tufts can also be regarded alternatively as a reference to a majority of bristles in accordance with this invention, as described above and below and in the claims. Furthermore, other types of dental cleaning elements can be used alternatively instead of bristles. Also it is possible for the tufts, as described in this connection, to be arranged not on outer, middle and inner rings but in outer, middle or inner regions arranged relative to each other.

The self-fanning bristles with the laterally protruding longitudinal ribs are grouped advantageously in corresponding tufts with non-self-fanning bristles such that a mixture of fanning and non-fanning bristles exists in the corresponding tuft. This enables a good nestling of the bristles around the tooth surface, a good distribution of cleaning agent and an agreeable cleaning sensation to be combined with a high cleaning performance with regard to the removal of plaque. Furthermore, the self-fanning can take place over several months in a controlled process. Also, a high density of bristles can be achieved in a tuft and hence on the bristle support of the brush head.

In particularly advantageous manner, the mixed tufts comprising both fanning bristles with lateral longitudinal ribs and normal bristles devoid of longitudinal ribs are arranged in an inner area of the bristled section of the brush head while tufts comprising non-fanning bristles are provided on an outer edge of the bristled section, in which arrangement said outer tufts can have advantageously in part a greater length and/or height than the inner lying tufts, such that a particularly effective cleaning of the interproximal spaces can be achieved with said outer tufts made of non-fanning bristles. At the same time, the fanning bristles in the inner area of the bristled section ensure an effective cleaning of the tooth flanks.

In an advantageous further aspect of the invention, the bristle body including its core section is free of points of preferred breaking, i.e., it has advantageously a homogeneous material structure and microstructure over its entire cross-section.

The self-fanning construction can be achieved generally in a variety of ways. In an advantageous further aspect of the invention, the bristles are shaped in a special configuration. In particular the bristle body can be shaped such that a ratio of an outer diameter of an enveloping cylinder enclosing the longitudinal ribs to a calipered minimum outer dimension determined by placing a sliding vernier caliper against the bristle body lies in the range of 1.10 to 1.30, approximately. Said ratio of the outer diameter of the enveloping cylinder to the calipered outer dimension can vary depending on the number of longitudinal ribs. If three longitudinal ribs are provided on the brush body, then said ratio of the outer diameter to the calipered outer dimension is advantageously between 1.10 and 1.25 and in particular 1.15, approximately. However, if four longitudinal ribs are provided on the bristle body, then said ratio of the outer diameter of the enveloping cylinder to said calipered outer dimension is preferably 1.10 to 1.30 and in particular 1.20, approximately.

The bristle body may generally have a varying number of longitudinal ribs. In an advantageous embodiment of the invention, in particular three or four longitudinal ribs are provided.

In addition the bristle body exhibits advantageously a certain ratio of the depth of the grooves between the laterally protruding longitudinal ribs to the outer diameter of the enveloping cylinder enclosing the longitudinal ribs. In an advantageous further aspect of the invention, the ratio of core diameter of an imaginary inner enveloping cylinder inscribed by the grooves between the longitudinal ribs to the outer diameter of said enveloping cylinder enclosing the longitudinal ribs is 0.5+/−0.15. Therefore, said outer enveloping cylinder is approximately twice as large as the core diameter.

The longitudinal ribs of the brush body generally can have different geometries. In a particular advantageous embodiment of the invention, the cross-section of the bristle body is in actual fact cloverleaf-shaped and/or the longitudinal ribs have an outer contour which corresponds to a pitch cylinder.

Alternatively however, the longitudinal ribs can have other outer contours. For example, the outer contours can correspond to pitch cylinders having a triangular cross-section, a rectangular cross-section, a rhombic cross-section or a hexagonal cross-section.

Advantageously, all the longitudinal ribs have a mutually identical outer contour in order to achieve uniform fanning.

The previously mentioned calipered outer dimension, which can be measured by applying a sliding vernier caliper such that the calipered minimum dimension can be set while the bristle is turned, can be generally between 5 and 9 mil, one mil being equal to 0.0254 mm. In an advantageous further aspect of the invention, said calipered dimension can be between 5.5 and 6 mil and in particular 5.75 mil, approximately. It will be understood, of course, that the previously mentioned calipering of the calipered dimension using a sliding vernier caliper is only meant figuratively in order to illustrate the definition of the calipered dimension. Because a conventional type of mechanical sliding vernier caliper would be too rough for the diameter dimensions mentioned, a suitable high-precision instrument such as a micrometer caliper would have to be used.

Said bristles with longitudinal ribs can be generally added in a varied mixture ratio to the non-fanned, normal bristles. Depending on the application it is possible to use more fanning bristles or more non-fanning bristles. A good compromise with regard to the removal of plaque on the one hand and to hugging the tooth surfaces and distributing the cleaning agent on the other hand is achieved in a further aspect of the invention by using x=50%+/−10% self-fanning bristles with laterally protruding longitudinal ribs on the one hand and y=50%+/−10% non-fanning normal bristles on the other hand per mixed tuft, where x+y=100%.

Generally, the non-fanning bristles can have various cross-sectional geometries. Advantageously, they are devoid of longitudinal ribs, with a basic geometrical cross-sectional shape such as rectangular or hexagonal. The bristles provided as non-fanning bristles are in particular bristles with a round, in particular circular, cross-section.

The non-fanning bristles have advantageously a diameter which is smaller than the previously mentioned calipered outer dimension of the self-fanning bristles with longitudinal ribs. For example, round bristles with a diameter of 5.5 mil can be mixed with self-fanning bristles with longitudinal ribs with a calipered outer dimension of 5.75 mil.

Particularly advantageous is the use of said self-fanning bristles in a bristled section on which tufts of a large cross-sectional area are concentrated at the outer edge of the bristled section and in its central area and tufts of a small cross-sectional area are provided between said large-area tufts at the edge and in the center on a middle ring of tufts. In particular within the elongated tufts on the outer ring there are arranged on a middle ring several tufts having a cross-section smaller than the cross-section of the elongated tufts, and within these small tufts on the middle ring there is provided at least one tuft with a cross-section larger than the cross-section of the tufts on the middle ring. By virtue of this rhythmic alternation of tuft cross-sections from inside to outside, it is possible to achieve a high bristle density and to better prevent a collision of the fastening means. Furthermore, advantages also arise with regard to the cleaning effect. Among other things, the dentifrice usually applied in the center of the bristled section is held better on the working surface.

Advantageously, the tufts of said middle ring and the innermost tufts are equipped with said self-fanning bristles.

In a further aspect of the invention, bristle tufts of various cross-sectional shapes are arranged on the at least one middle ring of bristles. In particular on said at least one middle ring bristle tufts may be provided which have an approximately square tuft cross-section. Alternatively or in addition, said middle ring may also include bristle tufts with a round cross-section, in particular a circular cross-section. If both angular, in particular square, and round, in particular circular bristle tufts are arranged on said middle ring, they are advantageously concentrated in different sectors each. To do this, a variety of options exist in general. According to one advantageous embodiment of the invention, round bristle tufts are arranged on the middle ring in opposing sectors, which in the non-deflected neutral position of the bristle support contain the toothbrush longitudinal axis. By contrast, the angular bristle tufts of the middle ring are advantageously arranged in opposing sectors of the bristle support which in the bristle support's neutral position are arranged symmetrically to a transverse axis.

In order to provide favorable space conditions for the securing of the bristle tufts, in a further aspect of the invention the angular bristle tufts of the middle ring, at least some of them, are turned at an acute angle relative to the main axes of the bristle support and also relative to the main axis of the annular contour of the ring on which they are arranged. In particular at least one of the angular bristle tufts, preferably every second angular bristle tuft, may have its main axis turned in such a way that the main axis of the bristle tuft cross-section is inclined at an acute angle to a tangent to the middle ring. As a result, corresponding anchor plates are turned out of the collision range of other anchor plates. In addition, the flexing behavior of the bristled section can be made more homogeneous on the whole and in particular less dependent on direction.

Regardless of their different cross-sectional shapes, the bristle tufts of the middle ring have at least by approximation roughly the same area of cross-section, with the areas of cross-section varying in a range of preferably less than +/−25%.

Compared to the areas of cross-section of the bristle tufts of the middle ring, the outer, elongated bristle tufts on the outer ring as well as the at least one innermost tuft in the center of the bristled section have an area of cross-section at least twice as large.

In this arrangement, on the outer ring of the bristled section there may be arranged advantageously several opposite lying pairs of elongated bristle tufts. For improved adaptation of the bristle configuration to the different cleaning tasks in different areas of the bristled section, said outer ring may include differently designed pairs of elongated bristle tufts which differ in respect of their bristle length and/or height and/or cross-sectional area.

Various configurations are generally possible in this context. According to an advantageous embodiment of the invention, opposing sectors of the bristle support, which in its non-deflected neutral position contain the toothbrush longitudinal axis, include longer bristle tufts and/or elongated bristle tufts of greater cross-sectional area than the tufts in sectors oriented at right angles thereto in a direction transverse to the toothbrush longitudinal axis.

In addition to the elongated bristle tufts, the outer ring may advantageously provide further bristle tufts of a not elongated contour, which advantageously may have an approximately round or square cross-section of a cross-sectional area smaller than the cross-sectional area of the elongated bristle tufts.

In an advantageous further aspect of the invention, the central area of the bristled section includes two equally elongated bristle tufts whose longitudinal axis, that is, the longitudinal dimension of the elongated cross-section, is aligned parallel to a main axis of the bristle support. In particular said innermost bristle tufts may have their longitudinal axes oriented parallel to the toothbrush longitudinal axis in the non-deflected neutral position of the bristle support and/or oriented towards the elongated bristle tufts of the outer ring which on the outer ring have the greatest height and/or greatest cross-sectional area.

The bristle support and/or the bristled section may generally have various outer contours, with the bristle support being advantageously of a round configuration in particular when driven rotationally. In a particularly advantageous further aspect of the invention however, the bristle support is not circular but of a shape deviating from the circular. In particular the bristle support may be of an oval or elliptical configuration or slightly flattened in a similar way. Alternatively or in addition, at least the outer row or the outer ring of bristle tufts may be arranged on an oval or on an ellipse or on a ring flattened in similar manner.

As seen looking at the top of the bristle support, the bristle tufts are advantageously arranged symmetrically relative to the main axes of the bristle support and/or rotationally symmetrically, in particular in such a way that the bristle tufts or their points of attachment on the bristle support are engageable one into the other by a turn through 180 degrees.

Alternatively or in addition, the bristled section may however have an asymmetrical contour as seen in a side view, in particular in a direction transverse to the toothbrush longitudinal axis, particularly in such a way that the height profile rises more intensively towards one side than towards the other side.

In a further aspect of the invention, the bristled section has a central depression in the working surface defined by the free ends of the bristle tufts, which advantageously may have a groove-shaped bottom curved in one direction and substantially straight in the direction perpendicular thereto. Through such a substantially uniaxially curved depression in a middle portion of the bristled section or its working surface, it is possible to achieve not only a better holding of the dentifrice or a similar, gel-type dental cleansing agent but above all a better cleaning effect on the teeth accompanied by a more agreeable, gentler cleaning sensation. The contour of the working surface, which rises to opposing circumferential sides, nestles better against the lateral tooth flanks which, so to speak, are enveloped in a snug fit so that in particular the sections of the tooth flanks adjoining the interproximal spaces are better cleaned.

Unlike bristled sections with plane depressions in the middle, it is not necessary for the innermost, i.e., central tufts, to bend away first. Rather, the bristle tufts rest in a snug fit against the lateral flanks of the teeth without bending away. In addition, a gentler cleaning sensation results, in particular when moving the brush head from one tooth to the next, because due to the varying tuft height also in the central region individual tufts are pushed away in succession when the brush sweeps over a tooth flank, the brush head being pushed, so to speak, along the curved surface of the depression around the flank of the next tooth without the brush head falling so to speak into the depression. In particular with rotational driving of the bristled section there results in addition a gentle wiping motion because the tufts hugging the tooth flank are more intensively bent as the distance from the axis of rotation increases.

The groove-shaped curvature of the depressed, central portion of the bristled section surface can be achieved generally in a variety of ways. For example, a correspondingly curved bristle support could be provided while the tufts are of uniform length. However, in a further aspect of the invention the tufts and in particular the inner lying tufts vary in their length such that they define with their free ends said groove-shaped curvature. In particular the length of the inner lying tufts can increase in the direction of the curvature of the working surface defined by the free ends with increasing distance from a center point of the bristle support, such as to define said groove-shaped curvature of the central depression. Through such a varying length of the tufts it is possible to achieve a gentle cleaning sensation and a gentle movement of the bristled section over the teeth because the further projecting bristles are able to bend away more easily on account of their greater length.

In order to obtain a most continuous curvature of the surface of the central depression, the free ends of the inner tufts, which define said working surface in the region of the depression, do not have end surfaces extending parallel to the bristle support but end surfaces which are inclined at an acute angle to the surface of the bristle support, with different inner tufts having differently inclined end surfaces, such that the differently inclined end surfaces define in mutual complementation the path of said groove-shaped contour of the central depression. In particular the inclination of the end surfaces of the free ends of the tufts can be made increasingly more pronounced as the distance of the tufts from the center of the bristle support increases, thus resulting in an increasingly steeper wall of the groove-shaped bottom in the direction of the circumferential edges of the bristled section.

Generally the tufts may form a plane surface at their free ends. In this case the inner tufts define said groove-shaped curvature so to speak in the form of a chine-type construction with a slant increasing in steps from tuft to tuft.

However, in a preferred further aspect of the invention, the free ends of the inner tufts can have at their free ends an end surface which is not plane but arcuately curved such that the mutually complementing free ends of neighboring tufts define a continuously curved enveloping surface which forms the previously mentioned groove-shaped depression. The curved end surfaces of the individual tufts are advantageously uniaxially curved, i.e., they are in themselves already curved in groove shape, so that they run in a straight line in one direction while having a curvature in a direction perpendicular thereto.

The groove-shaped curved bottom of the central region of the working surface of the bristled section can be generally of a symmetrical configuration, i.e., extending substantially parabolically. In this case the inner tufts rise with their free ends at a substantially equal rate to opposing circumferential sides of the bristled section.

In a further aspect of the invention provision can also be made advantageously for an asymmetric path of the curvature of the central depression in the working surface of the bristled section, in which case in particular a banana-shaped groove curvature can be provided. In this arrangement, the tufts defining the central depression in the working surface of the bristled section rise unequally to opposing circumferential sides so that the one upper edge of the groove-shaped depression is higher than the opposing edge. Among other things, this can be used, for example, to compensate for the tendency of users to position the brush head against the tooth flanks in a not exactly tangential but slightly V-shaped orientation.

To achieve an even more greatly improved interproximal cleaning effect, in a further aspect of the invention the outer, longer or higher tufts have at least one bevel on their free end surfaces. In particular the lateral edges of the end surfaces can be beveled in the manner of a chamfer. On the one hand said longer outer tufts can better penetrate into the interproximal spaces. On the other hand the brush head can be moved more easily and more gently from one tooth to the next because the bevels of the circumferentially outer lying tufts raise the bristled section so to speak in the manner of a wedge-shaped inclined surface onto the next tooth flank.

In this arrangement, the outer, longer tufts can be generally beveled towards both the inner side and the outer side. However, in an advantageous embodiment of the invention, only one bevel is provided on one of the sides of the respective tuft so that a sufficiently wide, non-beveled end surface remains, as a result of which a cleaning effect is achieved equally in the interproximal spaces and on the tooth flanks.

In a particularly advantageous further aspect of the invention, the outer edges of the free ends of the tufts, i.e., the edges facing away from the inner tufts, are beveled. As a result, the brush head can be pushed particularly gently from one tooth to the next.

Alternatively or in addition, the inner-side edge of the end surface of said outer, longer tufts can also be beveled. As a result, the working surface of the bristled section rests with a particularly snug fit against the round-bodied tooth flanks. The inner-side bevel is a continuation, so to speak, of the groove-shaped curved depression in the center of the working surface of the bristled section.

Depending on the application and configuration of the tufts, the bevel on the circumferential, longer tufts can be variously pronounced. A good cleaning effect both between the teeth and on their surfaces can be achieved when said bevel of the circumferential tufts is inclined at an angle of approximately 20° to 60° relative to the non-beveled end surface of said tuft. Generally, the depth of the bevel can be variously selected, with an advantageous compromise between easy entry into the interproximal spaces and remaining cleaning capability on the tooth flanks being accomplished if said bevel extends over approximately 25% to 75% of the width of the tuft at its end. In this context, "width" is understood to mean the dimension of the tuft vertically to its longitudinal axis and transversely to the longitudinal direction of the bevel.

Particularly effective are the circumferential, longer outer tufts, in particular in combination with said bevels, when said tufts are inclined at least with their outer side towards the outer circumferential side at an acute angle relative to a vertical on the bristle support, and this preferably at an angle in the range from 1.5° to 15°, preferably 3° to 10°, approximately. As a result the tufts acquire a reduced resistance to buckling in one direction during the to and fro motion of the brush head, thus giving rise to better insertion into the interproximal spaces.

In an advantageous further aspect of the invention, said longer outer tufts have a cross-sectional area that grows larger towards their free ends and/or lateral flanks that spread apart as they progress from the bristle support. In particular said circumferential outer tufts can be trapezoidally shaped as seen in a longitudinal sectional view, such that the free ends of the tuft are wider than its base on the bristle support. On the one hand, such a trapezoidal configuration lends the tufts a larger working surface on their free ends. On the other hand, the fan-type spreading apart enables the bristles within a tuft to move relative to each other with greater ease, which results on the whole in a better adaptation to the tooth contour and an improved cleaning performance. In particular with lateral bevels of the free ends of the tufts, said tufts acquire favorable geometrical proportions with more tangible edges which nestle better against the boundary contours of the teeth.

The trapezoidal configuration of the outer, longer tufts is advantageously asymmetric in relation to a vertical on the bristle support. In particular an inner flank of said tufts, which faces the inner tufts, can extend substantially vertically to the surface of the bristle support while an outer side of the respective tuft, which faces away from the inner tufts, is inclined towards the outer side at an acute angle to a vertical on the bristle support. Accordingly, the outer flanks stand off outwardly at an angle while the inner flanks stand straight, that is, they are aligned substantially vertically to the bristle support surface.

On the elongated bristle tufts, the previously mentioned bevel on the free end of the tuft extends advantageously parallel and/or tangentially to the longitudinal axis of the elongated end surface of the tuft.

In an advantageous further aspect of the invention, longer outer tufts are provided on the outer circumference in opposing circumferential sectors on opposing circumferential sides so that the central depression in the working surface of the bristled section extends between the opposing longer circumferential tufts. In this arrangement, the longer, outer tufts are advantageously not provided along the entire circumference of the bristled section but only in limited angular sectors of preferably less than 60° per sector angle, whereas no longer, elevated outer tufts are positioned circumferentially in intermediate sectors in which the groove-shaped curved depression in the central region is at its deepest. The groove-shaped central depression extends, so to speak, transversely across the entire bristled section. In said sectors in which the groove-shaped depression is at its deepest, the outer circumferential tufts are adapted to the configuration of the groove-shaped depression contour or they form part of it.

The brush head can be generally driven in a variety of ways. Different drive kinematics can be implemented depending on the configuration of the toothbrush and its drive. In an advantageous further aspect of the invention, the driving motion comprises an oscillatory rotational motion about an axis of rotation which extends through the bristle support. In an advantageous embodiment of the invention, said axis of rotation can extend vertically to the plane of the bristle support through its center point or center of gravity.

However, according to an alternative advantageous embodiment of the invention, it is also possible for the axis of rotation to be positioned eccentrically so that motion components of different magnitude are generated on different circumferential sides of the bristled section. In an advantageous further aspect of the invention, the eccentricity applies to the longer, outer tufts, that is, the axis of rotation is displaced parallel to a connecting line through the opposing, outer, longer tufts. Depending on the configuration of the bristled section, the eccentricity can be variously pronounced, with a good compromise between cleaning movements of desirably different size on different circumferential sides on the one hand and still tolerable vibrating movements on the other hand being achieved when the axis of rotation divides a diameter line of the bristle support in a length ratio of 55% to 45% up to 70% to 30%.

Alternatively or in addition, it is possible for the axis of rotation of the bristle support to be inclined at an acute angle to the plane defined by said support, with the angle of inclination being preferably in the range from 89° to 65°, in particular 88° to 82°, relative to the plane of the bristle support. As a result it is possible, in conjunction with the groove-shaped curved surface profile of the bristled section, to superimpose a poking motion upon the rotary motion. Preferably, the axis of rotation is tilted such that the bristled section is tilted away from the handpiece of the toothbrush.

Given a rotary oscillation of the bristled section, in an advantageous further aspect of the invention the end surface of the circumferentially outer, longer tufts, which looks elongated in the plan view, extends in an arc about the axis of rotation, in particular in a circular arc about the axis of rotation.

In a further aspect of the invention, the previously mentioned bevels on the outer ends of the longer, outer tufts can nevertheless extend in a straight line, preferably substantially tangentially to the arcuately curved, elongated end surface of the tufts. On the one hand this simplifies the production of the tufts. On the other hand this results in a circumferentially varying width of the bevels and, concomitant thereto, of the non-beveled end surfaces, which in the manner of wedge surfaces can cause the corresponding tufts to be continuously inserted into and withdrawn from the interproximal spaces.

However, according to an alternative advantageous embodiment of the invention it is also possible for the bevels to extend equally in an arcuate curve around the axis of rotation, in particular such that the bevels and/or the remaining, non-beveled end surfaces of the tufts have a contour and width that is constant in circumferential direction. As a result it is possible to achieve a particularly gentle contacting of the tufts with the tooth flanks and a favorable penetration into the interproximal spaces.

The outer, longer tufts enclose the inner tufts along a distance covering 25% to 75%, approximately, of the circumference of the bristled section or the bristle support.

The inner tufts, which with their free ends define said central depression in the working surface, can form with their free ends a substantially continuous surface such that an in actual fact continuous groove-shaped depression results. On the one hand, it is thus possible to achieve a nestling around the full surface of the tooth flanks and hence a cleaning effect covering a large area. On the other hand, it has a beneficial effect on the positioning of the dentifrice or the tooth cleaning agent, which is held better on the working surface of the bristled section and does not flow so easily between the tufts down onto the bristle support.

In an alternative, advantageous further aspect of the invention, said inner tufts can form with their free ends separate end surfaces, as a result of which a better discharge of dislodged debris is achievable.

Advantageously, the bristles are configured in such a way that the self-fanning of the bristle ends is gradually intensified while cleaning the teeth with a toothbrush (electric or not) with said bristles.

These and further features of the invention which, when used singularly or in any sub-combination irrespective of their summary in the claims, may form the subject-matter of the present invention will become apparent not only from the claims but also from the subsequent description and the accompanying drawings explaining preferred embodiments of the invention in greater detail. In the drawings, FIG. 1 is a schematic side view of an electric toothbrush having a rotationally drivable brush head according to a preferred embodiment of the invention;

Figure 1:
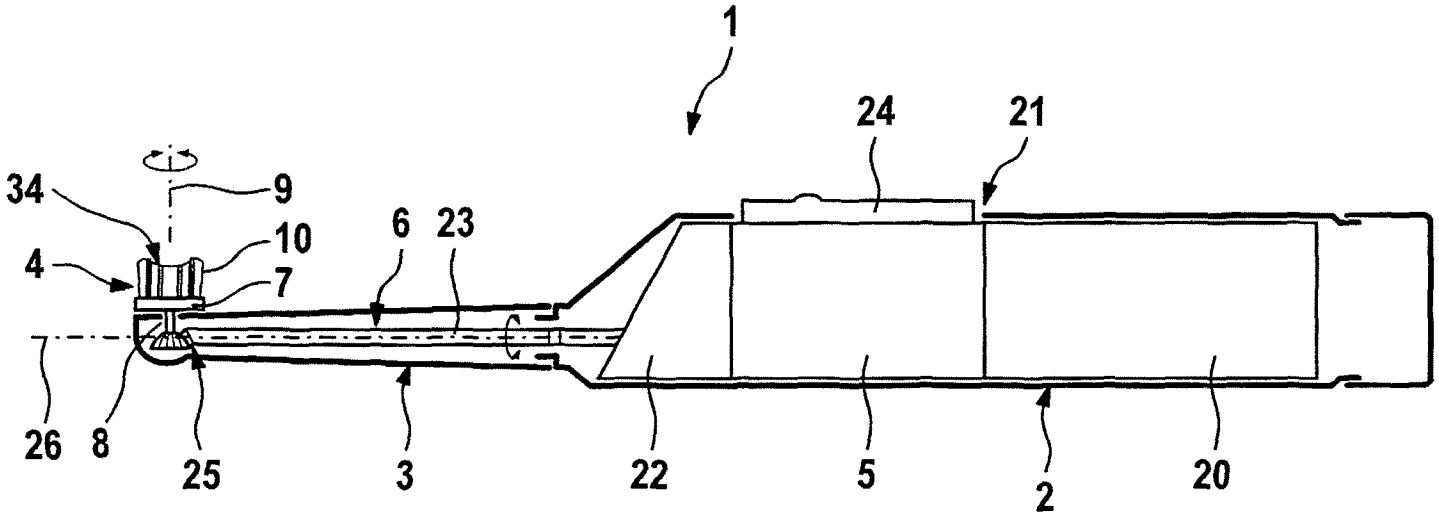
Figure 4:
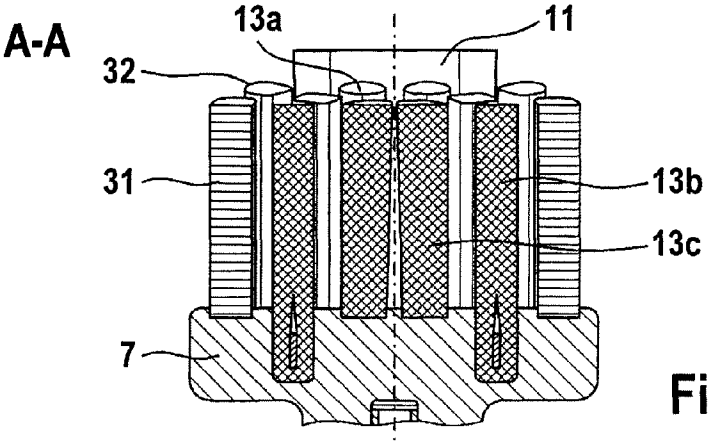
FIG. 4 is a longitudinal sectional view of the brush head of FIG. 2 taken along the line A-A of FIG. 2.

The toothbrush 1 shown in FIG. 1 comprises a handpiece 2 and a brush head 4 adapted to be coupled to it. To be more precise, the brush head 4 is adapted to be coupled to a neck 3 of the toothbrush 1 connected to the handpiece 2, said neck being constructed in the form of a hollow brush tube. However, it would also be possible for the brush head 4 to comprise said neck 3 or at least part of it and to be adapted to be coupled with it to the handpiece 2.

The handpiece 2 accommodates in its interior an energy source 20, preferably in the form of a rechargeable battery, a motor 5, preferably in the form of an electric motor, and a control device 21.

In the embodiment shown, the rotary motion of the motor 5 is translated by means of a gearing 22 into an oscillatory rotational motion of a drive shaft 23 which extends through the neck 3 to the brush head 4. The toothbrush 1 can be activated and deactivated with a switch 24 mounted on the handpiece 2.

In known manner using a suitable gearing (preferably a bevel gearing 25 unlike in the shown embodiment), at the end of the drive shaft 23 the brush head 4 is set into an oscillatory rotational motion about an axis of rotation 9 by a pushrod transmission, which axis extends substantially in a direction transverse to the toothbrush longitudinal axis 26. As this occurs, the angular range swept by the bristle support 7 of the brush head 4 has a value advantageously in the range of ±35°±5°, approximately, with an oscillation in the range from ±10° to ±100° being also possible. The oscillation frequency can vary and lie, for example, between 10 Hz and 100 Hz. In the embodiment shown in FIG. 1, the axis of rotation 9 forms a right angle with the toothbrush longitudinal axis 26. In addition, a drive of the brush head 4 is provided in a third dimension for its pulsing motion in the direction of the axis of rotation or oscillation.

Figure 2:
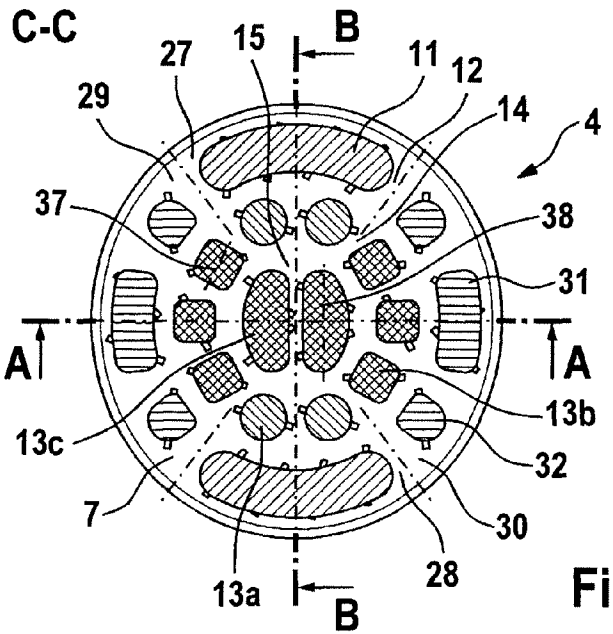
FIG. 2 is a top plan view of the brush head of the toothbrush of FIG. 1.

A preferred embodiment of the brush head 4 of the toothbrush 1 is shown in FIGS. 2 to 5. In this embodiment, the bristle support 7 is round, however advantageously not circular but slightly oval and/or elliptical, with the longer axis of the oval or the ellipse in the neutral position of the bristle support 7 extending parallel to the toothbrush longitudinal axis 26, and the shorter axis of the oval or the ellipse extending in a direction transverse to it. In FIG. 2 the longer axis of the oval or the ellipse is parallel to the line B-B.

Arranged on the bristle support 7 is a plurality of bristle tufts which are arranged in several rings 12, 14 and 15 shaped in an approximately circular or non-circular (such as oval) configuration and spread over the bristled section 10. Positioned on an outer ring 12 in the illustrated embodiment of FIG. 2 are eight tufts, of which four have an elongated contour while another four have a—roughly speaking—round or equilateral cross-sectional contour. The length of the tufts on said outer ring 12 varies, as will be explained in more detail, with—roughly speaking—longer tufts being provided generally in opposing sectors 27 and 28, which in the initial position of the bristle support 7 contain the toothbrush longitudinal axis 26, than in sectors 29 and 30, which are orientated in a direction transverse thereto or lie in between, cf. FIG. 2.

As FIG. 2 shows, the tufts 11 and 31 lying on the outer ring 12 on the main axes B-B and A-A, respectively, are elongated in the plan view while the tufts 32 lying in between have an approximately equilateral contour or an approximately cubic or round cross-section. Said elongated tufts 11 and 31 extend in an arcuate curve around the axis of oscillation or rotation 9, cf. FIG. 2.

In this arrangement, the outer tufts 11 sitting on the longer main axis B-B extend over a circumferential section of approximately 50° to 90°, preferably approximately 70°, while the outer tufts 31 sitting on the shorter main axis A-A extend over a circumferential section of 20° to 45°, approximately, preferably 30°, approximately.

Positioned on a second ring 15 of tufts, seen from the outside, are a total of ten tufts 13*a* and 13*b*, of which some have a circular cross-section and others an angular cross-section. In particular tufts 13*a* with a circular cross-section are arranged, as shown in FIG. 2, in the sectors 27 and 28 in which the longer outer tufts 11 of the outer ring 12 lie, while angular tufts are provided in the intermediate sectors 29 and 30 of the bristle support 7 on the second ring 14. Also, the length of these tufts 13*a* and 13*b* on the second ring 14 varies cyclically from tuft to tuft along the circumference of the ring 14, in such a way that longer tufts are provided in said sectors 27 and 28 than in the sectors 29 and 30 lying on the short main axis.

The round bristle tufts 13*a* as well as the angular, approximately square bristle tufts 13*b* of the middle ring 14 have approximately at least about the same area of cross-section regardless of their different cross-sectional contour.

As FIG. 2 shows, to provide favorable space conditions for the securing of the bristle tufts, in a further aspect of the invention the angular bristle tufts 13*b* of the middle ring 14, at least some of them, may be turned at an acute angle relative to the main axes A-A and B-B of the bristle support 7 and also relative to the annular contour of the ring 14 on which they are arranged. Particularly at least one of the angular bristle tufts, preferably each second angular bristle tuft 13*b*, may have its main axis 37 turned in such a way that the main axis 37 of the bristle tuft cross-section is inclined at an acute angle to a tangent to the middle ring 14. This causes corresponding anchor plates to be turned out of the collision range of other anchor plates. In addition, the flexing behavior of the bristled section can be made more homogeneous on the whole and in particular less dependent on direction.

Finally, in an innermost area or in a third ring of tufts as seen looking from outside two elongated bristle tufts 13*c* are provided which extend with their longitudinal axis 38 parallel to the longer main axis B-B.

The innermost bristle tufts 13*c* have a cross-sectional area significantly greater than the bristle tufts 13*a* and 13*b* of the middle ring. In the embodiment shown, their cross-sectional area amounts to between 200% and 400% of the cross-sectional area of the bristle tufts 13*a* and 13*b* of the middle ring 14.

In this arrangement, the innermost bristle tufts 13*c* are of an elongated configuration so that their longitudinal dimension 38 amounts to more than 150% of their transverse dimension, preferably 150% to 300%, approximately. In the embodiment shown, the innermost bristle tufts 13*c* advantageously have an outer contour curved in convex shape while an inner contour is straight, with the inner and outer contours being advantageously connected by rounded end contours.

Advantageously, the innermost bristle tufts 13*c* have their longitudinal axes 38 aligned parallel to the main axis of the bristle support which in the non-deflected neutral position of the bristle support 7 extends parallel to the toothbrush longitudinal axis 26 or a longitudinal center plane passing therethrough. The tufts form with their free bristle ends a homogeneous bristle surface. This is achieved by the provision of tufting hole walls which are slightly inwardly inclined (at an angle of between 1.5° and 3°).

Figure 3:
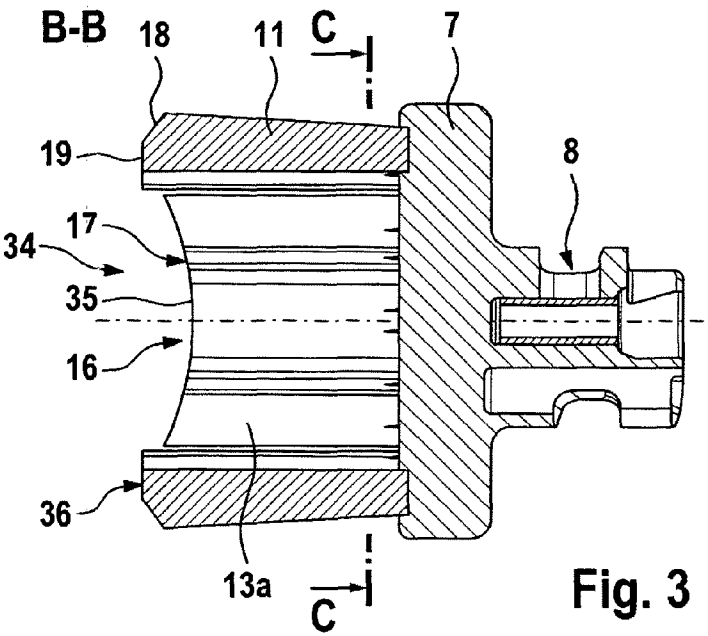
FIG. 3 is a longitudinal sectional view of the brush head taken along the line B-B of FIG. 2 parallel to the longitudinal axis of the toothbrush.

As FIG. 3 shows, the tufts of the bristled section 10 have their free ends contoured or coordinated with each other with regard to their length and/or height, such that the working surface 34 of the bristled section 10 as defined by the free ends of the tufts has a central depression 16 with a groove-shaped bottom 17 which is curved in one direction and straight in a direction vertical to it. The curvature extends advantageously in the direction of the longer main axis B-B or in the direction of the toothbrush longitudinal axis 26 when the bristle support 7 is in its non-deflected neutral position. In a direction perpendicular thereto, which extends parallel to the shorter main axis A-A of the bristle support 7 and/or transverse to the toothbrush longitudinal axis 26 when the bristle support 7 is in its non-deflected neutral position, the depression 16 has a straight contour as shown in FIG. 3.

The central depression 16 can be constructed to be variously deep. In an advantageous further aspect of the invention, the deepest point of the depression 16 is set an amount of approximately 1 mm to 3 mm, preferably approximately 2 mm, deeper than the highest point of the bristled section 10. The groove-shaped contour of the bottom 17 of the depression 16 generally can have different curvatures. In the embodiment shown in FIGS. 3 to 5, a circular-arc-shaped contour with a curvature radius in the range from 8 mm to 17 mm, preferably approximately 11 mm to 14 mm, is provided, but this can vary depending on the dimensions and configuration of the bristled section.

As FIG. 3 shows, the end surfaces of the inner tufts 13*a*, 13*b* and 13*c* and the end surfaces of the shorter, outer tufts 31, which likewise combine to define the groove-shaped bottom 17, are not constructed as plane surfaces but are likewise in themselves curved in groove shape. The groove-shaped curved end surfaces 35 complement each other and in combination form said groove-shaped contour of the bottom 17 of the central depression 16. In concrete terms, the inclination of the end surfaces of the inner tufts 13 increases as the distance from the axis of rotation 9 in the direction parallel to the main axis B-B increases, cf. FIG. 3. In other words, the tufts arranged on the transversally extending main axis A-A are slightly curved at their free ends but nevertheless are aligned substantially parallel to the bristle support surface, while the inclination of the free ends increases as the distance from said main axis A-A increases.

As FIG. 3 also shows, the outer tufts 11 arranged on the outer ring 12 in the sectors 27 and 28 are extended relative to the other tufts or have a greater height such that they project beyond the other tufts. This results in a step in height relative to the central depression 16, cf. FIG. 3, that is, the central depression 16 in the embodiment shown in FIG. 3 does not merge smoothly with the end surfaces of said outer tufts 11.

Said outer tufts 11 in the opposing sectors 27 and 28, which in the neutral position of the bristle support contain the toothbrush longitudinal axis 26, have advantageously end surfaces 36 that comprise a flat section 19, which is aligned substantially vertically to the longitudinal axis of the tufts 11, as well as bevels 18, which bevel said end surfaces 36 towards the outside.

Figure 5:
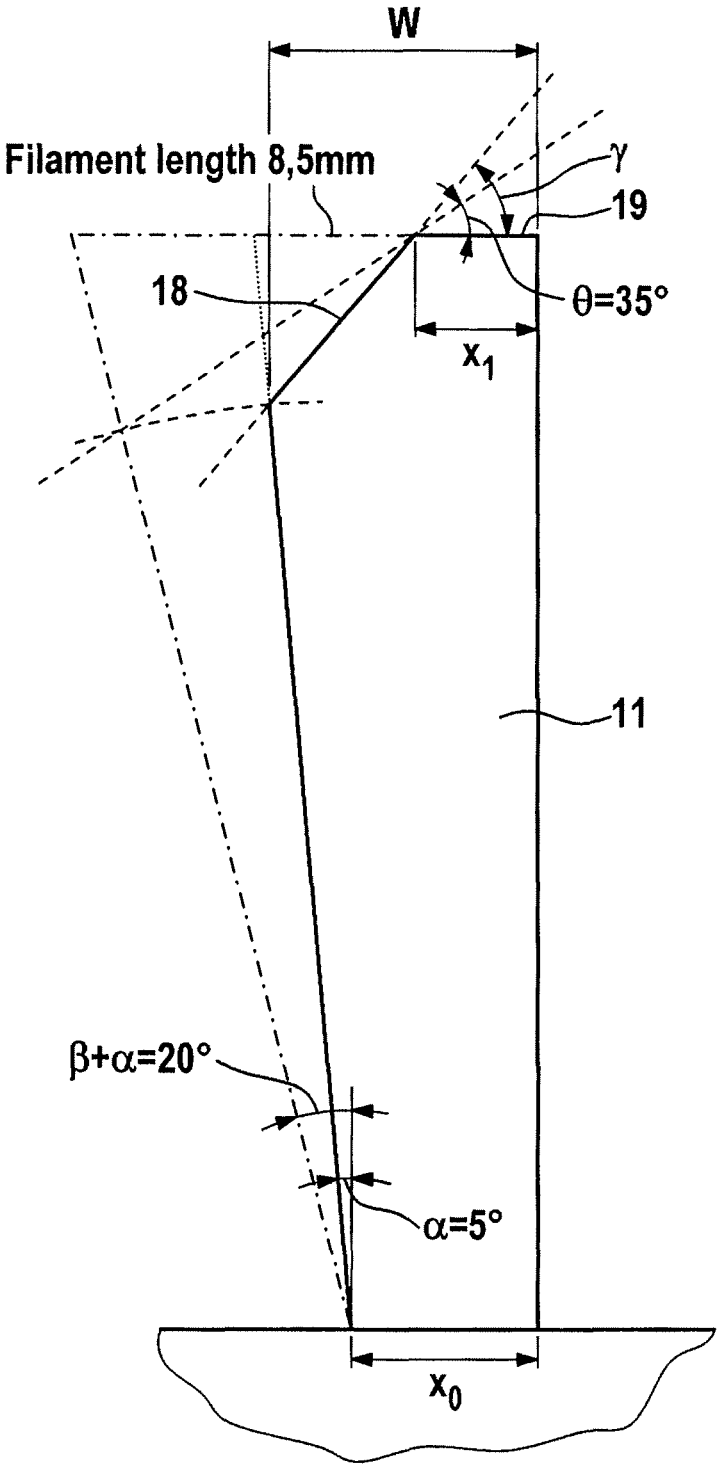
FIG. 5 is an enlarged side view of one of the outer, longer bristle tufts of FIG. 3 in an enlarged schematic representation showing the bevel angles of the tuft.

As FIG. 5 shows, said bevels 18 extend at an angle γ in the range from 20° to 60°, preferably 30° to 40°, approximately. The bevels 18 are advantageously so deep and wide as to cover approximately 25% to 75% of the width W of the respective tuft 11. In this case the width W is understood to be the dimension of the tuft vertically to its longitudinal axis and vertically to the longitudinal dimension of the bevel 18, in the region of the free end of the tuft, cf. FIG. 5. In the embodiment shown in FIG. 5, the bevel extends over approximately ¼ to ¾ of the width W.

Said longer outer tufts 11 are on the whole of a trapezoidal configuration as seen in their longitudinal section. While the inner lying flank of the tuft 11 extends substantially vertically to the plane defined by the bristle support 7, the outer lying flank is inclined towards a vertical on the bristle support 7 at an angle α of approximately 1.5° to 10°, preferably approximately 3° to 5°, such that the cross-section of the tuft 11 increases towards its free end, that is, the tuft becomes wider towards its free end. As a result, a large working surface is obtainable with a limited size of the bristle support 7. In addition, favorable geometrical proportions result at the free end of the tuft 11 in relation to its bevel 18.

In order to embrace the tooth flanks as completely as possible, to distribute the brushing pressure over a wide area and to hold dentifrice or the like on the working surface 34, the tufts occupy with their free ends advantageously at least 35% to 55%, preferably 50% or more of the area defined by the bristle support 7. As FIG. 2 shows, the tufts on the outer ring 12 can extend over a circumferential section of 200° to 300°, approximately, when the extension of all tufts is added together. The second ring 14 of tufts, seen from the outside, can extend likewise over a circumference of altogether 200° to 300°, approximately, when the extension of all tufts along the circumference is added together. The innermost tufts can cover with their free ends advantageously an area substantially closed over its full surface.

Advantageously, the tufts defining the central depression 16 are equipped at least partly with self-fanning bristles, whereby in particular the tufts (13*a* and 13*b*) shown in FIG. 2 of the middle ring 14 and/or the innermost tufts 13*c* (and where applicable the tufts 13*a* of the middle ring) can comprise such self-fanning bristles.

Figure 6:
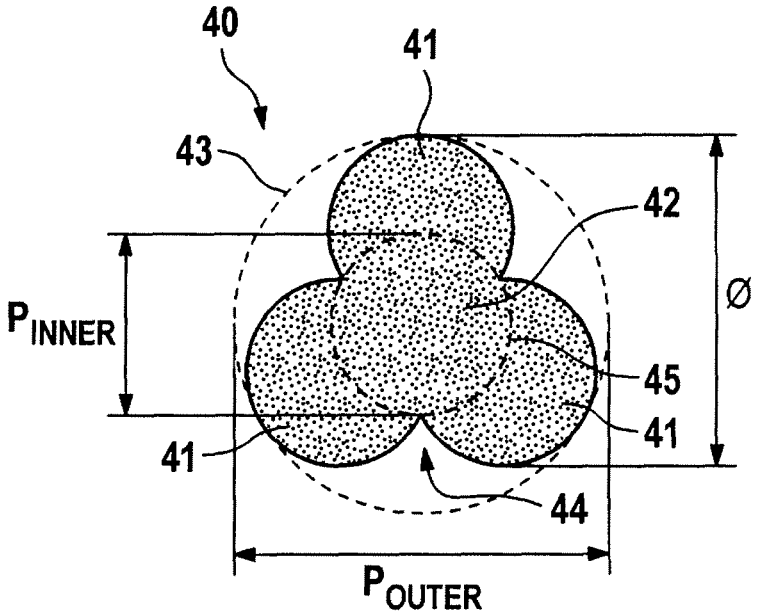
FIG. 6 is a schematic cross-sectional view of a self-fanning bristle according to an advantageous embodiment of the invention having three laterally protruding longitudinal ribs.

FIG. 6 shows a preferred embodiment of such a self-fanning bristle with a cross-section which generally remains constant over its length and is constructed advantageously to be cloverleaf-shaped, as shown in FIG. 6. The bristle body 40 comprises three laterally protruding longitudinal ribs 41 which protrude from a core section 42 in star shape towards the outer circumferential side. The longitudinal ribs 41 are spread evenly over the circumference. Advantageously, the longitudinal ribs 41 have an outer contour which corresponds to a section of a circular cylinder.

The geometrical proportions are advantageously selected such that an enveloping cylinder 43 placed around the longitudinal ribs 41 has an outer diameter $P_{outer}$ while an imaginary core enveloping cylinder 45 inscribed by the grooves 44 lying between the longitudinal ribs 41 has a diameter $P_{inner}$, with the ratio of $P_{inner}$ to $P_{outer}$ being selected in the range of 0.5+/−0.15.

Furthermore, the calipered outer dimension ϕ shown in FIG. 6 is selected through suitable construction of the longitudinal ribs 41 such that in the embodiment shown it amounts to 5.75 mil. This results in a ratio of the outer diameter of the enveloping cylinder 43 $P_{outer}$ to said calipered outer dimension ϕ in the range from 1.0 to 1.3 and in particular 1.15.

As FIG. 6 shows, the longitudinal ribs 41 in the three-rib configuration describe an outer contour in the form of a pitch cylinder 43 whose diameter corresponds approximately to the diameter $P_{inner}$ of said core enveloping cylinder 45.

The bristle is formed advantageously from polyamide, in particular nylon 6.12.

Figure 7:
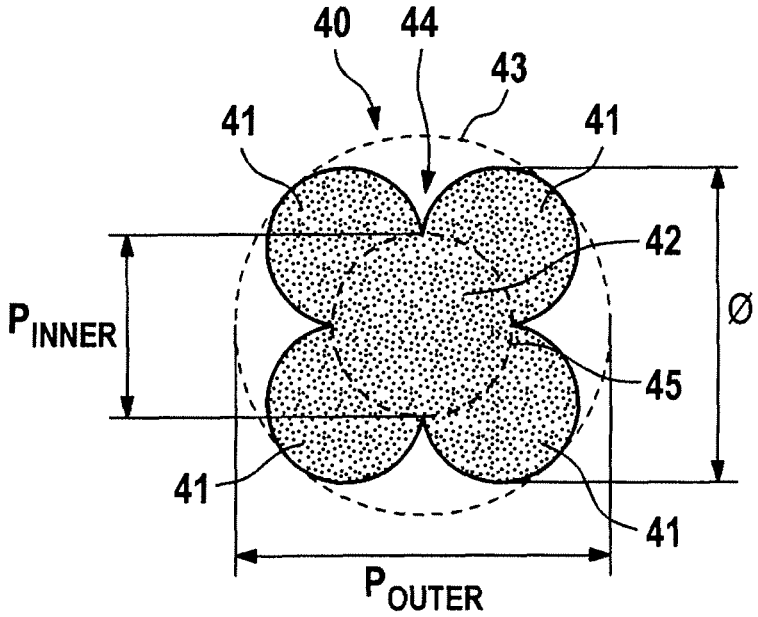
FIG. 7 is a schematic cross-sectional view of a self-fanning bristle according to another advantageous embodiment of the invention having four laterally protruding longitudinal ribs.

FIG. 7 shows another embodiment of the bristle. The basic concept corresponds essentially to FIG. 6 so that corresponding reference numerals are used. FIG. 7 differs from FIG. 6 essentially in that instead of three longitudinal ribs 41 four longitudinal ribs 41 are provided and in that the brush body 40 therefore has the cross-section of a four-leaf clover. Here too the longitudinal ribs 41 are spread evenly over the circumference and are equipped with an outer contour which corresponds to a pitch cylinder.

The geometrical proportions are selected such that the ratio of the diameter $P_{inner}$ of the core enveloping cylinder 45 to the diameter $P_{outer}$ of the outer enveloping cylinder 43 equals approximately 0.5+/−0.15. In this four-ribbed version the ratio of said diameter $P_{outer}$ of the enveloping cylinder 43 to the calipered outer dimension ϕ equals advantageously 1.10 to 1.30 and in particular approximately 1.20. In the embodiment shown, said calipered outer dimension ϕ again equals approximately 5.75 mil.

Advantageously, the self-fanning bristles shown in FIGS. 6 and 7 in the previously mentioned tufts of the middle ring 14 and the innermost tufts 13*c* are combined with "normal", meaning non-self-fanning bristles, and this advantageously in a mixing ratio of 50+/−10% to 50+/−10%, approximately.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A bristle for a toothbrush comprising, a plastic monofilament body, the bristle body cloverleaf-shaped in cross-section having at least three longitudinal ribs having an outer contour corresponding to a section of a circular cylinder, which project laterally from a core section of the bristle body, such that the outer contour of each longitudinal rib directly contacts the core section at two or more positions, wherein the bristle body is self-fanning by the action of cleaning forces; and wherein the bristle body is shaped such that a ratio of a diameter $P_{inner}$ of a core enveloping cylinder inscribed by grooves between the longitudinal ribs to an outer dimension $P_{outer}$ of an enveloping cylinder enveloping the longitudinal ribs amounts to 0.5+/−0.15.

2. The bristle according to claim 1 wherein the bristle body including its core section has a homogeneous material structure and microstructure.

3. The bristle according to claim 1 wherein the bristle body is shaped such that a ratio of an outer diameter $P_{outer}$ of an enveloping cylinder enclosing the longitudinal ribs to a calipered outer dimension Φ determined by placing a sliding vernier caliper against the bristle body lies in the range of 1.10 to 1.30.

4. The bristle according to claim 3 wherein said ratio of outer diameter $P_{outer}$ to calipered outer dimension Φ amounts to 1.15 on a bristle body having three longitudinal ribs, and to 1.20 on a bristle body having four longitudinal ribs.

5. The bristle according to claim 4 wherein said calipered outer dimension Φ amounts to between 5 and 9 mil.

6. The bristle according to claims 1 wherein the longitudinal ribs have an outer contour which corresponds to a pitch cylinder.

7. The bristle according to claim 1 wherein the longitudinal ribs have an outer contour corresponding to a pitch cylinder having a triangular cross-section, a rectangular cross-section, a rhombic cross-section or a hexagonal cross-section.

8. The bristle according to claim 1 having four longitudinal ribs.

9. The bristle according to claim 1 wherein the bristle comprises polyamide.

10. A brush head for a toothbrush having a substantially plate-shaped bristle support carrying a bristled section with a plurality of bristle tufts wherein at least one of the bristle tufts contains at least one bristle according to claim 1.

* * * * *